US008584575B2

(12) United States Patent
Crommett

(10) Patent No.: US 8,584,575 B2
(45) Date of Patent: Nov. 19, 2013

(54) FIREARM HAVING A NEW GAS OPERATING SYSTEM

(76) Inventor: Richard Vance Crommett, Los Angeles, CA (US)

( * ) Notice: Subject to any disclaimer, the term of this patent is extended or adjusted under 35 U.S.C. 154(b) by 0 days.

(21) Appl. No.: 13/607,585

(22) Filed: Sep. 7, 2012

(65) Prior Publication Data

US 2013/0276624 A1 Oct. 24, 2013

Related U.S. Application Data

(62) Division of application No. 12/139,407, filed on Jun. 13, 2008, now Pat. No. 8,261,653.

(60) Provisional application No. 60/936,086, filed on Jun. 18, 2007, provisional application No. 61/000,080, filed on Oct. 22, 2007.

(51) Int. Cl.
*F41A 5/00* (2006.01)

(52) U.S. Cl.
USPC ..... 89/193; 89/191.01

(58) Field of Classification Search
USPC ..... 89/191.01, 193, 198
See application file for complete search history.

(56) References Cited

U.S. PATENT DOCUMENTS 2,003,066 A * 5/1935 Brondby ..... 89/193
4,765,224 A * 8/1988 Morris ..... 89/191.01
5,272,956 A * 12/1993 Hudson ..... 89/128

* cited by examiner

*Primary Examiner* — Gabriel Klein
(74) *Attorney, Agent, or Firm* — Donald L. Bartels; Bartels Law Group

(57) ABSTRACT

A method of operating a firearm having a modified gas operating system including directing gas from a barrel of a firearm upward through a barrel gas port, routing the gas from the barrel gas port through a gas jet, directing the gas from the gas jet through a gas operation tube, and directing the gas to a bolt carrier assembly to move at least a portion of the bolt carrier assembly relative to the barrel, the movement of the at least a portion of the bolt carrier assembly to cause excess gas in the barrel to be vented through the gas jet.

3 Claims, 13 Drawing Sheets

FIGURE 16
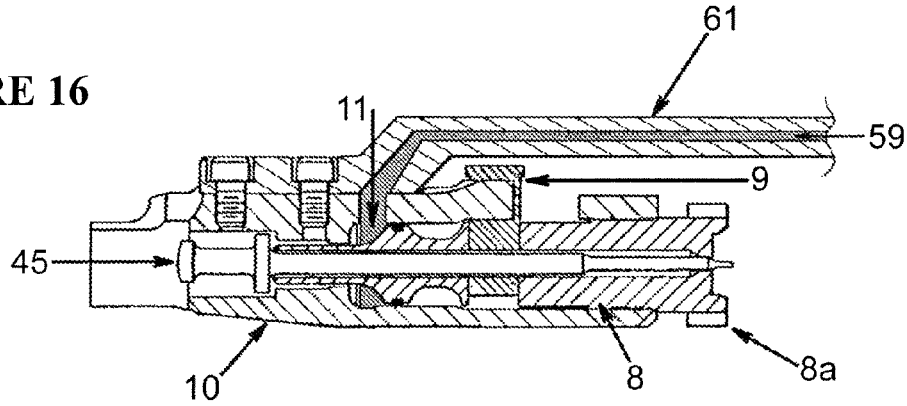
FIGURE 17
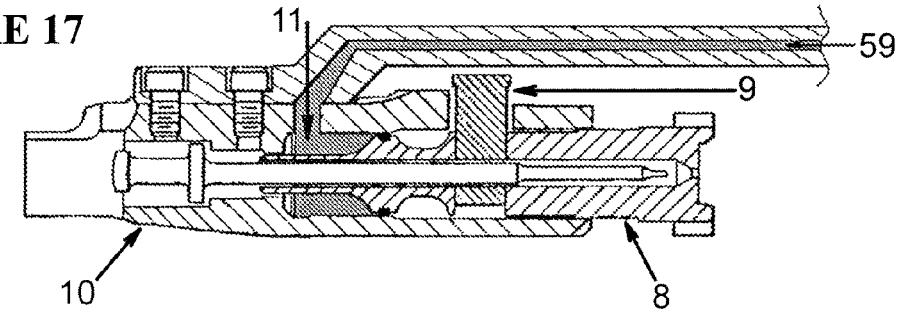
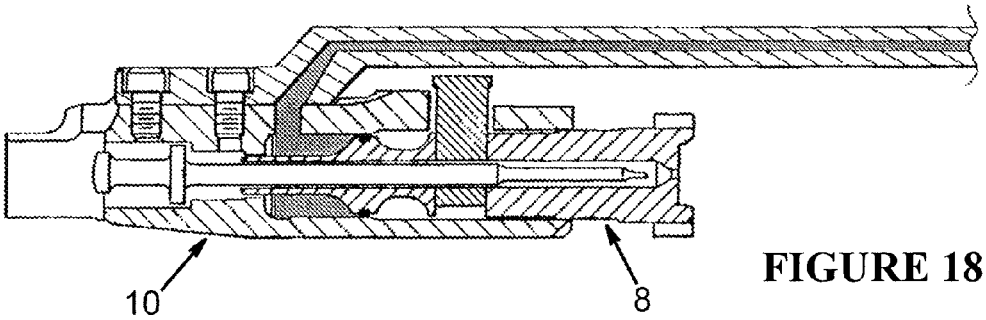
FIGURE 18

FIREARM HAVING A NEW GAS OPERATING SYSTEM

CROSS REFERENCE TO RELATED APPLICATIONS

This application is a divisional of prior application Ser. No. 12/139,407, entitled "FIREARM HAVING A NEW GAS OPERATING SYSTEM, filed Jun. 13, 2008, now U.S. Pat. No. 8,261,653.

The present application claims priority to U.S. Provisional Application No. 60/936,086, entitled "Firearm having a new gas operating system," filed Jun. 18, 2007, the entirety of which is hereby incorporated by reference. The present application also claims priority to U.S. Provisional Application No. 61/000,080, entitled "Rifles, short barreled rifles, and pistols having a new gas operating system," filed Oct. 22, 2007, the entirety of which is hereby incorporated by reference.

BACKGROUND

1. Field

The present invention relates to firearms. More particularly, the present invention relates to automatic, semi-automatic and similar types of rifles and modifications to the rifles.

2. Related Art

There are several problems prevalent in automatic and semi-automatic rifles, such as the family of M-16/AR-15 rifles. The family of M-16/AR-15 rifles discussed herein includes but is not limited to the AR-10, AR-15, M16, M16A1, M16A2, M16A3, M4, M4A1, CAR-15, etc.

FIGS. 1 and 2 illustrate conventional M-16/AR-15 firearms in further detail. As shown in FIGS. 1 and 2, these firearms have an upper receiver 100 with a barrel 4, a front sight 55 on the barrel 4, a handguard 66, and a rear sight 76 on top of the receiver 100. The upper receiver 100 includes a cartridge magazine 103 filled with cartridges 102. In FIG. 1, one cartridge 102 is loaded into the chamber 5*a* next to the bolt 8 and bolt carrier 10. The firearm also includes a lower receiver 67, which is shown with a trigger 95, trigger guard 96, pistol-style hand grip 72. A shoulder stock 23 is connected to the upper receiver 100 and the lower receiver 67. The firearm also includes a recoil/buffer assembly 17 having a recoil spring 20 mounted in a recoil/buffer tube 21. The recoil/buffer tube 21 extends from and attaches to the lower receiver 67 and is positioned in-line with the barrel 4.

As is shown in FIGS. 1 and 2, the placement of the recoil/buffer assembly 17 directly in-line with the barrel 4 dictates the placement of the shoulder stock 23 in less than ideal positions for the operator. Shoulder stocks 23 for the standard M-16/AR-15 firearms use the recoil/buffer assembly 17 as a structural member and most such structures enclose the recoil/buffer assembly 17. Even if the stock 23 is placed elsewhere, the recoil/buffer assembly 17 cannot move, and sticks out nearly one foot from the back of the receiver 100, which can be awkward for the shooter.

These firearms are operated by a direct gas impingement system, as shown in FIGS. 3-8. The direct gas impingement system directs gas from a fired cartridge to a bolt carrier to cycle the firearm. One major problem with the prior art direct gas impingement system is the venting of hot propellant gases into the receiver areas (i.e., upper receiver 100 and lower receiver 67) of the firearm during operation. In particular, in a standard M-16/AR-15 firearm, hot propellant gas is vented into the upper receiver as the bolt carrier assembly is driven aft and separates from the gas transfer tube. This venting of the propellant gases becomes a problem because the propellant gases carry grimy powder residues and therefore dictate the need for scrupulous and frequent cleaning of virtually all parts of the rifle. Even with frequent cleaning, jamming can occur during long periods of usage. The tube used to deliver these gases into the receiver area also becomes fouled. This small gauge tube, which is difficult to access and clean, can become constricted over time and the resulting lower gas pressure may be insufficient to operate the firearm.

These propellant gases that are vented into the receiver area of the rifle are also very hot. The hot gases enter the receiver area just micro-seconds after being created by an explosion in the cartridge chamber. These hot gases hasten the breakdown of the firearms lubricants and coatings which increases wear, thereby shortening the life of components and increasing the likelihood of jamming.

FIG. 3 illustrates the prior art gas operating system of the M-16/AR-15 firearm in battery just after firing. The gas operating system includes a barrel 4, a bolt carrier assembly 10, a gas block 54, a gas tube 60 and a carrier key 15. In FIG. 3, the bullet 104 is shown traveling down the barrel 4 and is illustrated in a position just before the gas block 54.

FIG. 4 illustrates the firearm's condition just after the bullet has passed the gas block 54. As is seen, the hot, high pressure propellant gas, described above, is routed up through the gas block 54, gas tube 60, and bolt carrier key 15, and into the center of the bolt carrier 10, driving the bolt carrier 15 aft into its recoil position. FIG. 4 also illustrates the venting of contaminating propellant gas 59*a* into the upper receiver 100 after the carrier key 15 has disengaged from the gas transfer tube 60. This hot, high pressure propellant gas 59*a* contaminates the inside of the upper receiver 100, coating it with carbon residue and breaking down lubricants. This in turn may cause jamming and shorten the life of components, as described above.

FIGS. 5-8 illustrate the operation of the prior art gas impingement system in further detail. As shown in FIG. 5, the prior art gas impingement system includes a bolt carrier assembly, which includes a bolt carrier 10, bolt carrier key 15, bolt 8, and firing pin 45. The bolt carrier assembly also includes a cam pin 9 to rotate the bolt 8.

As shown in FIG. 6, the burst of expanding high pressure propellant gas 59 from an ignited cartridge traveling up the barrel 4, is routed aft through the gas transfer tube 60, and into a void 11 within the center of the bolt carrier assembly just behind the bolt 8.

As shown in FIG. 7, the pressure of the gas 59 in the void 11 forces the bolt 8 and the bolt carrier 10 in opposite directions, similar to the movement of a piston (i.e, bolt 8) within a cylinder (i.e., bolt carrier 10). The bolt 8 is restrained from moving forward while the bolt carrier 10 moves aft because bolt locking lugs 8*a* are locked into the barrel extension lugs. The carrier 10 moves aft, directly in line with the barrel and starts to separate the carrier key 15 from the gas transfer tube 60. Then, the carrier 10 engages the bolt cam pin 9 in the bolt cam slot 9*a* which rotates the bolt to unlock the bolt from the barrel extension. As shown in FIG. 7, the bolt is in an extended, unlocked position.

With reference to FIG. 8, the bolt 8 and bolt carrier 10 are then driven aft together to a full recoil position, helped by the remaining high-pressure gas in the barrel 4. The final travel of the carrier 10 separates the carrier key 15 from the gas transfer tube 60 and vents hot, contaminating, propellant gasses 59*a* into the upper receiver 100. These vented hot gases coat the inside of the receiver with carbon fouling which, without proper maintenance, can build up and eventually cause jamming and extensive component wear, as described above.

The standard gas system of M-16/AR-15 firearms was originally designed for a rifle having an approximate barrel length of 20" and having a gas port in the barrel at about 13" from the receiver. Over the years, the AR-15/M-16 family's barrels have gotten shorter as manufacturers have sought to configure the AR-15/M16 to fit different end user needs. Unfortunately, shortening the barrel and changing the port location changes the operation of the gas system. The placement and size of the gas port and the length of the barrel between the gas port and the forward end of the barrel are an integral part of the operating system design. The distance of the port from the firing chamber, the diameter of the barrel interior, and the power of the cartridge largely determine the gas pressure entering the port as the bullet passes; the size of the gas port determines the gas pressure down stream from the port; the distance of the port from the firing chamber and the distance of the gas path back to the center of the bolt carrier determines the initial gas timing; and, the distance from the gas port to the end of the barrel determines the duration of the gas system pressure.

The timing of the gas system is important, because as the cartridge is fired, the casing's cylindrical walls expand to seal the chamber so the high pressure gases do not vent around the sides of the spent cartridge into the receiver. The spent cartridge stays expanded and stuck in the chamber until the bullet has traveled far enough down the barrel and the pressure drops enough for the casing to contract. The residual gas in the barrel assists in the extraction of the cartridge and supplies some of the energy to move the carrier rearward.

The minimum distance for dependable operation is with the port about 7.5" from the receiver. Even with that minimum distance, the M-16/AR-15 family of firearms may not function reliably with a full range of ammunition. Some AR-15 style weapons are made with much shorter barrels with gas ports about 4.75" from the receiver. The gas pressure when the bullet passes the port with the shorter barrels can be as high as 50,000 psi.

This extreme pressure traveling in such a short gas path initiates the carrier's action before the empty casing has had time to contract away from the walls of the chamber. The firearm may function most of the time, but the high pressures often causes problems. For example, the bolt's case extractor is exposed to increased stress because the extractor tries to pull the stuck case out by the case rim, subjecting the extractor to breakage. In another example, the extractor sometimes rips the back off of the spent case. In addition, if the extractor spring is not strong enough, the extractor can slip off of the cartridge rim. Also, if the spring is too strong, the extractor may not slip into place over the rim when the cartridge is loaded into the chamber.

Another problem with the prior art M-16/AR-15 rifles is that the shoulder stock does not sit comfortably or properly against the shooter's shoulder, which does not allow for efficient absorption of recoil energy or for comfortable rifle handling. In an upright shooting stance, up to half of the upper part of the stock end is above and not in contact with the shooters shoulder. The most efficient transfer of recoil energy is to spread it over as large an area as possible. The felt recoil from the 0.223/5.56 mm cartridge is not great, but with the M-16/AR-15 now being adapted for much more powerful ammunition, the handling of recoil energy is becoming more important to the shooter.

FIG. 9 illustrates a man preparing to fire a prior art firearm in the M-16/AR-15 family. In particular, FIG. 9 shows how the original M-16/AR-15 style stock 23 sits high on the shooters shoulder 80 in a common shooting stance. As described above, the stock 23 cannot be moved lower on the firearm because the recoil/buffer tube 21 extends into the shoulder stock 23.

FIG. 10 shows a prior art M-16/AR-15 style firearm illustrating that the placement of the recoil/buffer tube 21 at the top of the shoulder stock 23 sets the placement of the stock 23 high on the firearm. In the M-16/AR-15 style of firearms, the top of the shoulder stock 23 is on a slightly higher horizontal plane than the top of the barrel 4. Because of the height of the stock 23, the shooter's head and eye line 77 cannot get close to barrel 4. This raises the normal sightline 77 to more than 2" above the barrel centerline, which causes inefficient parallax. This parallax is particularly evident when the shooter shifts his point-of-aim from a close target to a distant one, or the reverse. In this case, the projectile's point-of-impact changes dramatically in relation to the point-of-aim unless the sights are adjusted for the change in distance. Parallax is typically not a problem for target shooters who shoot at a single distance; however, parallax can be a significant problem for hunters, action competition shooters, law enforcement and the military. The relationship 79 between the sightline 77 and the stock 23 and the distance 78 between the barrel 4 and the sightline 77 are also illustrated in FIG. 10. As shown in FIG. 10, because of the rear mounted recoil tube, recoil spring and buffer assembly, the standard M-16/AR-15 is a relatively long weapon.

Other firearms, such as the AK-47 and FAL, use piston driven gas operating systems. The piston driven gas operating systems do not vent operation gases into their receivers. Instead, propelling gasses drive a piston which in turn drives a piston rod. This piston rod impacts and drives the bolt carrier assembly of the weapon. Although the gas piston operating system leaves the receiver cleaner and cooler, the gas piston operating system induces vibration and flexes the barrel. The power to operate gas piston systems is delivered off-line from the barrel which causes the barrel to flex and vibrate each time a cartridge is fired. This flex and vibration is the reason that firearms having gas piston systems are inherently less accurate than firearms having direct gas impingement systems.

SUMMARY OF THE INVENTION

The following summary of the invention is included in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

In one embodiment, the new firearm gas operating system includes a forward mounted gas system in which high pressure propellant gases from the cartridge expand in the barrel and operate the firearm. The gas operation system includes a gas jet block mounted over a barrel and a bolt carrier assembly in the receiver of the firearm. A gas port connects the barrel to the gas jet block. The gas jet block includes a gas jet and an operation tube docking port, which extends a short distance towards the receiver of the firearm and is open on its receiver-facing end. The firearm also includes a gas operation tube—an end of the gas operation tube is attached to and moves with the bolt carrier, and the other end of the gas operation tube telescopes into the gas jet block operation tube docking port. The tip of the operation tube is in contact with, or in close proximity to, the gas jet when the firearm is in battery. A helically wound recoil spring is mounted as a sleeve over a length of the gas operation tube and has a retainer near the forward end of the operation tube.

In use, when the cartridge propellant is ignited, the burst of expanding high pressure propellant gas travels up from the barrel, is routed aft through the gas jet into and through the gas operation tube, and into the bolt carrier assembly (i.e., bolt carrier, bolt, and firing pin). The bolt carrier assembly directs the high pressure burst of gas into a void within the center of the bolt carrier, just behind the bolt.

The pressure of the gas forces the bolt and the bolt carrier in opposite directions, similar to the movement of a piston (i.e., bolt) within a cylinder (i.e., bolt carrier). The bolt is restrained from moving forward, because it is locked into the barrel extension lugs, so only the bolt carrier is able to move aft. The carrier pulls the operation tube aft. The carrier also engages a cam which unlocks the bolt from the barrel extension. The bolt and bolt carrier are then driven aft together, helped by the remaining high-pressure gas in the barrel. It will be appreciated that the recoil spring is compressed when the operation tube is moved (i.e., when the bolt carrier assembly is driven to its aft recoil position by the gas pressure). In addition, when the bolt is pulled out of the barrel extension, an extractor pulls the spent cartridge from the chamber and an ejector throws the spent cartridge out of the receiver through an ejection port.

The bolt carrier assembly is then pulled forward, back into the battery position, by the energy released from the compressed recoil spring. As the bolt carrier assembly moves towards its battery position it picks up another cartridge from the magazine, drives the cartridge into the chamber and engages the cam, which rotates the bolt locking lugs into a locked position within the barrel extension. This movement also causes the operation tube to reengage with the gas jet. The firearm is then ready to fire the next round.

According to one aspect of the invention, a firearm includes a barrel; a gas barrel port fluidly coupled with the barrel; a gas jet block fluidly coupled with the gas barrel port, the gas jet block comprising a gas operation tube docking port and a gas jet in the gas operation tube docking port to meter gas flow from the barrel; a gas operation tube fluidly engaged with the gas jet; a bolt carrier assembly comprising a carrier and a bolt, the gas operation tube fixedly connected to the carrier and fluidly coupled with the bolt carrier assembly, the bolt carrier assembly movable to disengage the gas operation tube from the gas jet as a function of gas pressure in the bolt carrier assembly, the gas jet venting gas from the gas jet block when the gas operation tube disengages from the gas jet; and a spring positioned with respect to the gas operation tube to cause the tube to reengage the gas operation tube with the gas jet.

According to another aspect of the invention, a firearm includes a barrel; a receiver fixed to the barrel; a bolt carrier assembly in the receiver and comprising a carrier and a bolt in-line with the barrel, the carrier movable relative to the bolt; a gas jet block connected to the barrel and comprising a gas operation tube docking port and a gas jet in the gas operation tube docking port; a slideable gas operation tube fixed to the carrier, wherein gas is directed from the barrel through the gas jet and into the gas operation tube, the gas operation tube to direct the gas to the bolt carrier assembly to move the carrier relative to the bolt as a function of gas pressure in the bolt carrier assembly and to cause the gas jet to vent excess gas from the barrel when the carrier moves; and a spring positioned with respect to the gas operation tube to move the gas operation tube when a spring force of the spring overcomes the gas pressure in and on the bolt carrier assembly.

The firearm may be selected from the group consisting of AR-10, AR-15, M16, M16A1, M16A2, M16A3, M4, M4A1 and CAR-15.

The gas operation tube may be in contact with the gas jet when the gas operation tube is directing gas from the gas jet to the bolt carrier assembly. The gas operation tube may be between about 0.000 and 0.005" from the gas jet when the gas operation tube is fluidly engaged with the gas jet. The gas jet block may include an expansion chamber. The gas jet block may also include an end screw in the operation tube docking port, the expansion chamber between the gas jet and the end screw. The end screw may be actuatable to adjust the volume of the expansion chamber. The position of the gas jet in the gas operation tube docking port may be adjustable. The carrier may include a vent opening.

The firearm may include a shoulder stock, a pistol grip or a shoulder stock and a pistol grip. The shoulder stock may be a folding shoulder stock or a collapsible stock.

The spring may be wound around the operation tube and coupled to the receiver and the gas operation tube. The firearm may include a rear retainer clip to releasably couple the spring to the firearm. The spring may include a retainer to releasably couple the spring to the operation tube. The gas jet block may be mounted on the barrel.

The firearm may also include a cover to cover the spring wherein the gas is vented under the cover from the gas jet. The cover over may be a handguard, the handguard having an opening, the gas vented into the opening of the handguard. The firearm may also include a handguard, the handguard having an opening, the gas vented into the opening of the handguard. The cover may also cover the gas jet block.

The bolt carrier assembly may further include a void between the carrier and the bolt, wherein the carrier moves relative to the bolt when the gas pressure in the void is sufficient to move the carrier. A diameter of the gas block at the docking port may be greater than the diameter of the gas block at the gas jet.

According to one aspect of the invention, a method includes directing gas from a barrel of a firearm upward through a gas barrel port; routing the gas from the gas barrel port through a gas jet; directing the gas from the gas jet through a gas operation tube; and directing the gas to a bolt carrier assembly to move at least a portion of the bolt carrier assembly relative to the barrel, the movement of the at least a portion of the bolt carrier assembly to cause excess gas in the barrel to be vented through the gas jet.

The bolt carrier assembly may include a bolt carrier and a bolt, and directing the gas to the bolt carrier assembly to move at least a portion of the bolt carrier assembly relative to the barrel may include directing the gas into a void in the bolt carrier to force the bolt and the bolt carrier to move in opposite directions as a function of the gas pressure in the void; moving the bolt carrier and operation tube in an aft direction when the gas pressure in the void is sufficient to move the bolt carrier and operation tube in the aft direction, the movement of the gas operation tube compressing a recoil spring coupled with the operation tube; engaging the carrier with a cam to unlock the bolt from a barrel extension; and moving the bolt carrier and bolt in an aft direction. The method may further include releasing the recoil spring to pull the bolt carrier assembly forward.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

FIG. 16 is a side cross-sectional view of the bolt carrier assembly and operation tube in battery in accordance with one embodiment of the invention.

FIG. 17 is a side cross-sectional view of the bolt carrier assembly and operation tube in accordance with one embodiment of the invention.

FIG. 18 is a side cross-sectional view of the bolt carrier assembly and operation tube in recoil in accordance with one embodiment of the invention.

DETAILED DESCRIPTION

Figure 1:
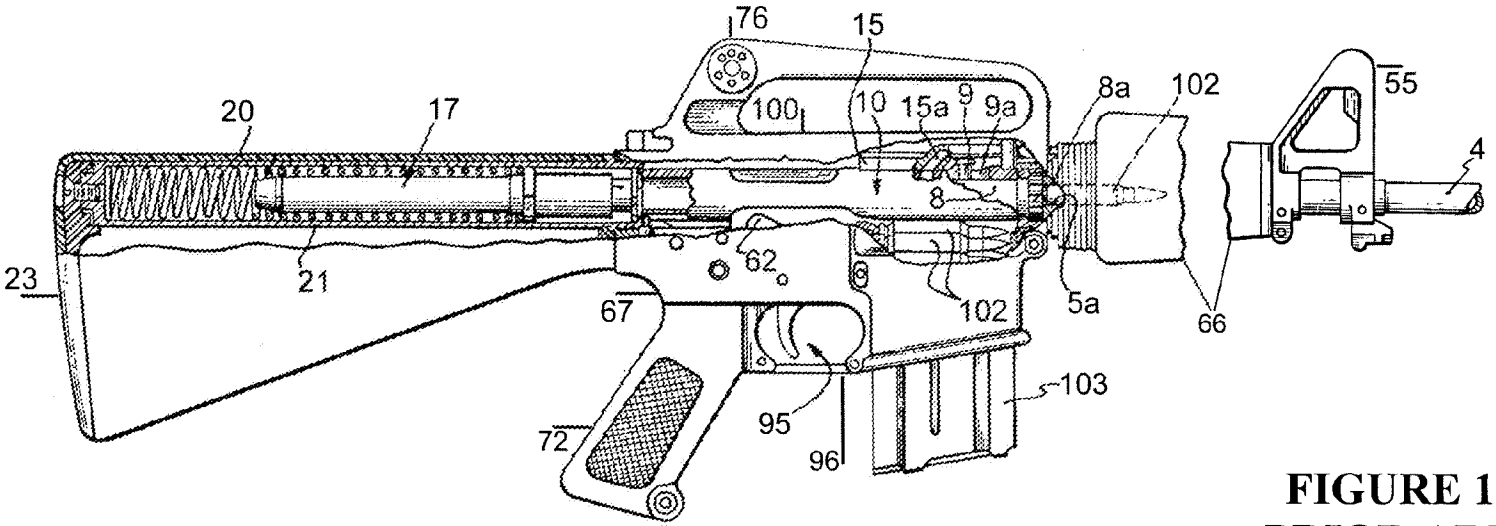
FIGURE 1 PRIOR ART
FIG. 1 is a side, partial cross-sectional view of a prior art recoil spring buffer assembly and receiver area.
Figure 2:
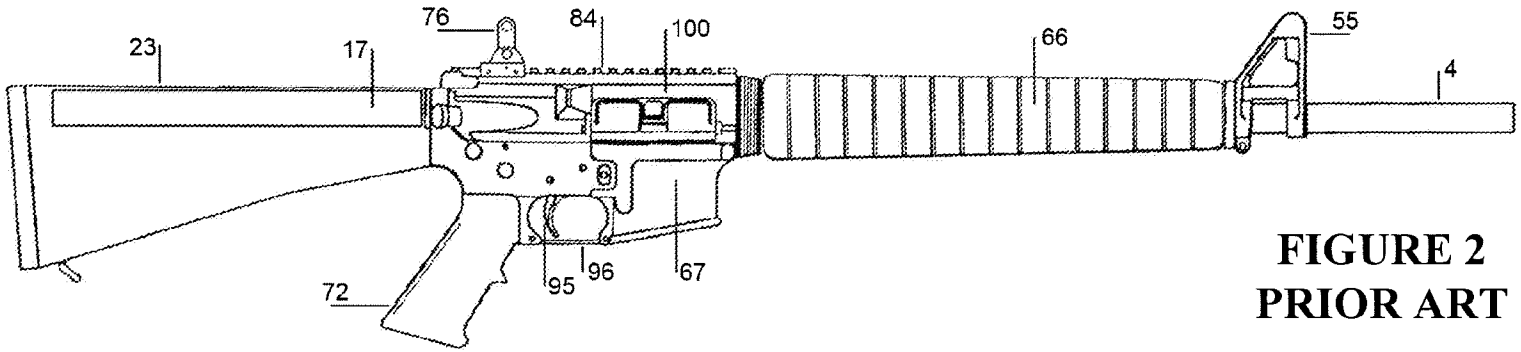
FIGURE 2 PRIOR ART
FIG. 2 is a side view of a prior art M-16/AR15.
Figure 3:
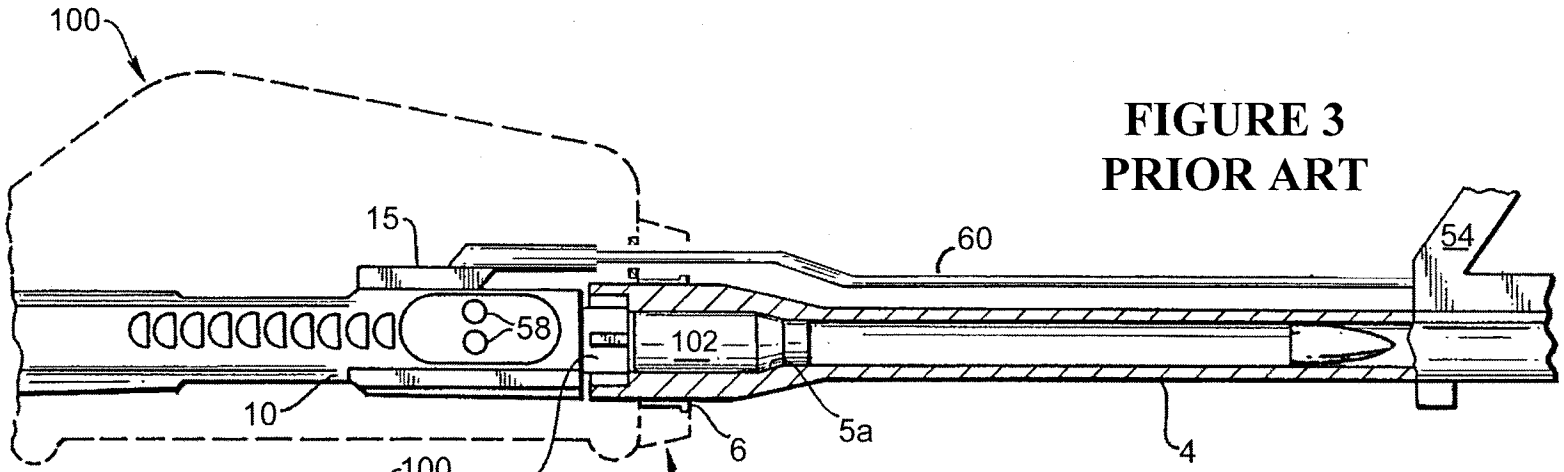
FIGURE 3 PRIOR ART
FIG. 3 is a side cross-sectional view of a prior art bolt carrier assembly, barrel, and gas system in battery.
Figure 4:
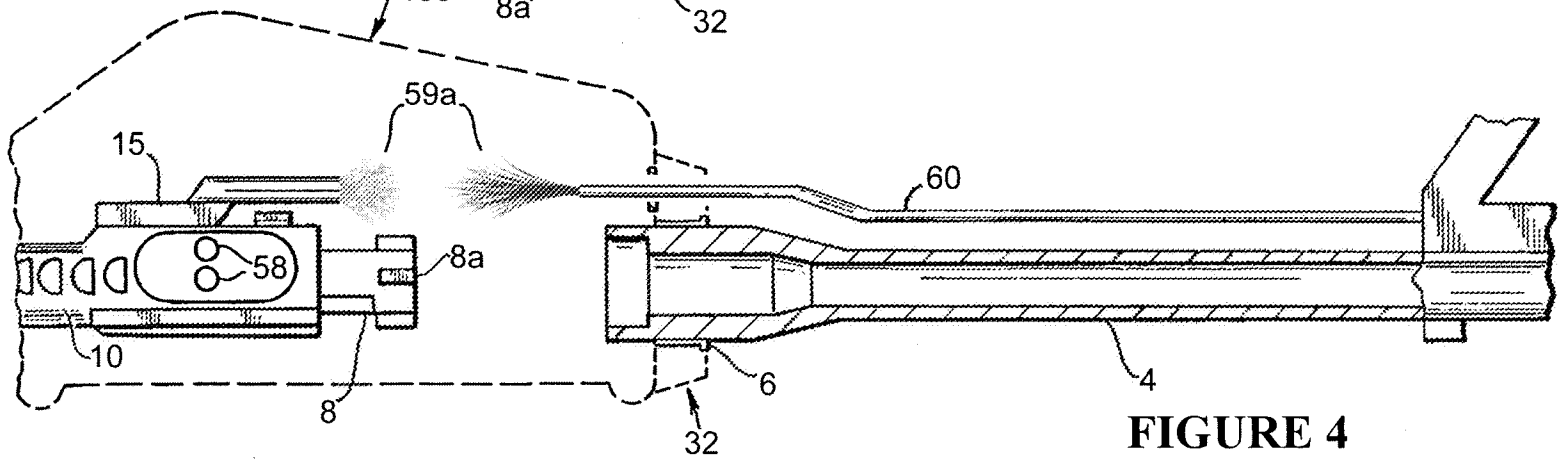
FIGURE 4 PRIOR ART
FIG. 4 is a side cross-sectional view of the prior art bolt carrier assembly, barrel, and gas system in recoil.
Figure 5:
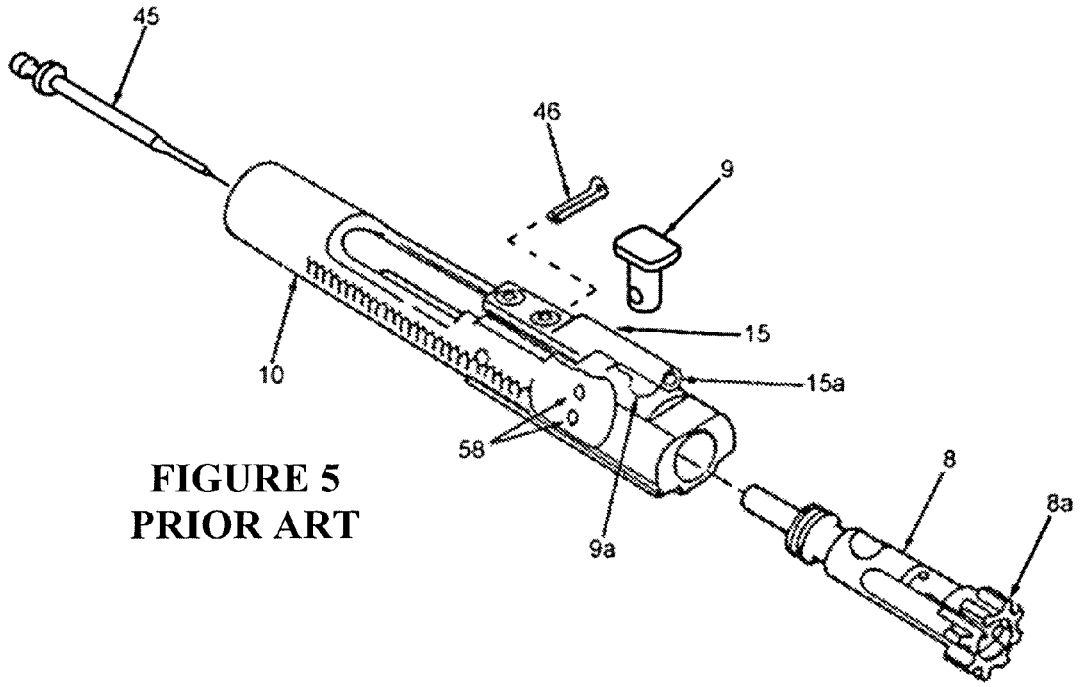
FIGURE 5 PRIOR ART
FIG. 5 is a top perspective view of the prior art bolt carrier assembly.
Figure 6:
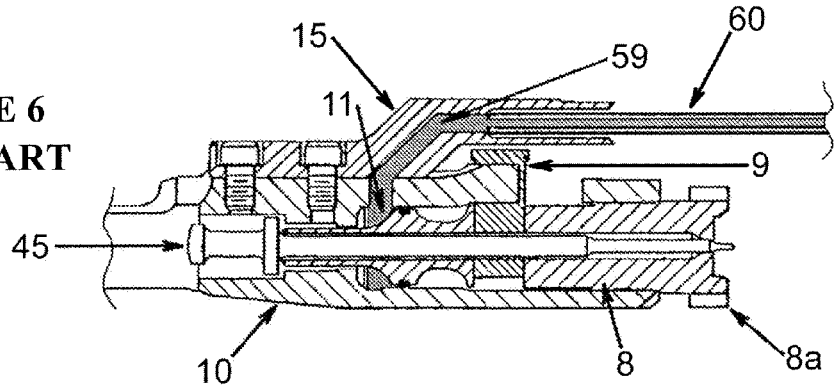
FIGURE 6 PRIOR ART
FIG. 6 is a side cross-sectional view of the prior art bolt carrier assembly and gas tube in battery.
Figure 7:
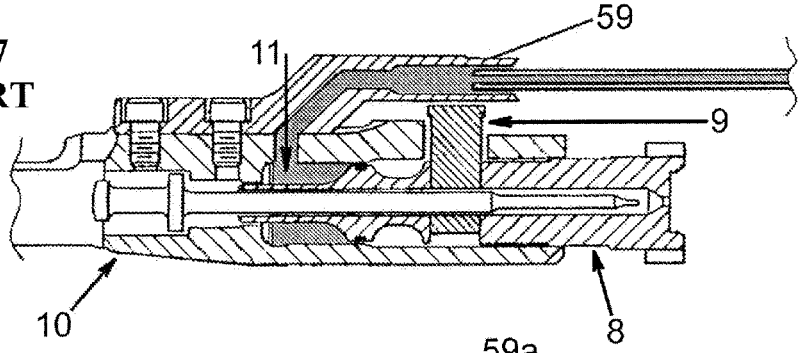
FIGURE 7 PRIOR ART
FIG. 7 is a side cross-sectional view of the prior art bolt carrier assembly and gas tube.
Figure 8:
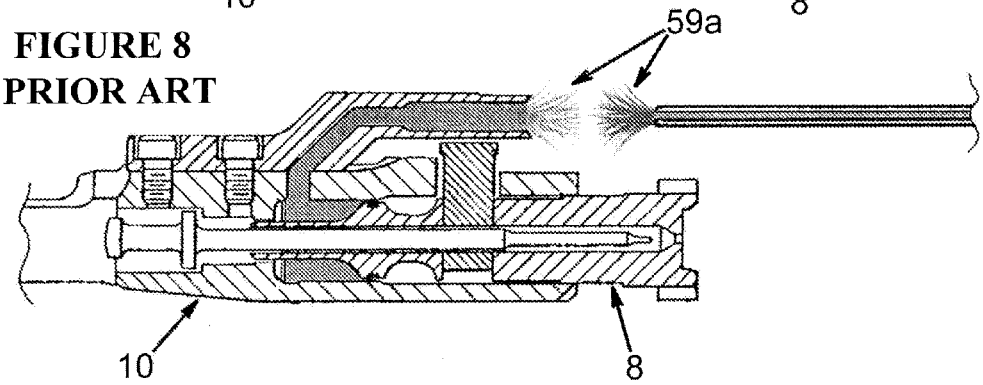
FIGURE 8 PRIOR ART
FIG. 8 is a side cross-sectional view of the prior art bolt carrier assembly and gas tube in recoil.
Figure 9:
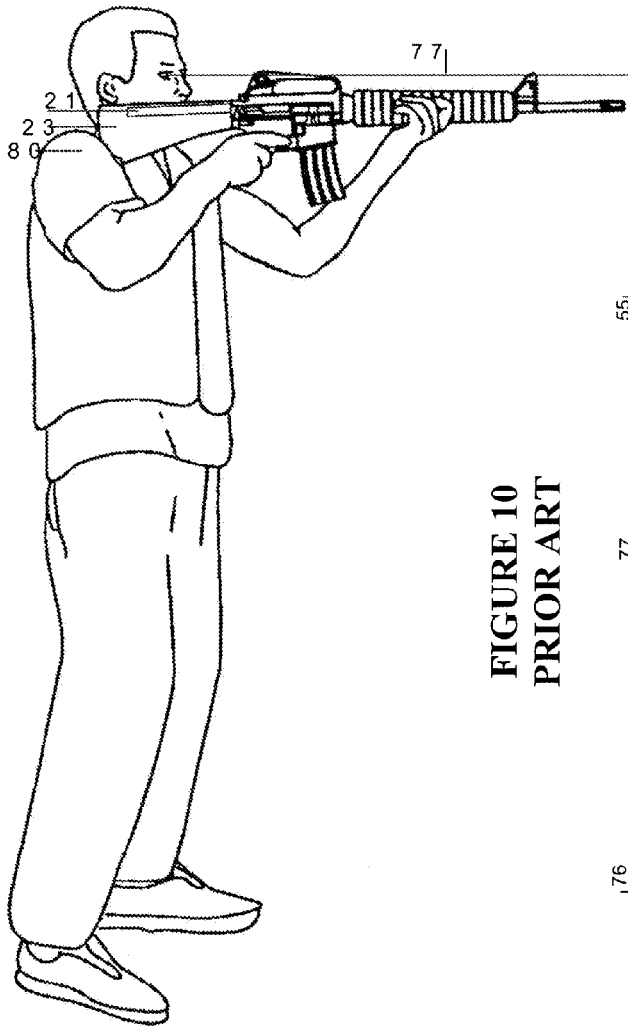
FIGURE 9 PRIOR ART
FIG. 9 is a schematic view of a standing person preparing to shoot a prior art M-16/AR-15 style firearm.

Embodiments of the invention relate to modifications to firearms. In particular, embodiments of the invention relate to modifications for the family of M16/AR-15 rifles. The family of M16/AR-15 rifles may include but is not limited to the AR-10, AR-15, M16, M16A1, M16A2, M16A3, M4, M4A1, CAR-15, etc. It will be appreciated that the family of M16/AR-15 rifles includes all manufacturers of the various models of MR16/AR-15 rifles. It will also be appreciated that the modifications described herein may used to modify rifles having different operating systems.

In accordance with one embodiment of the invention, the firearm is modified such that the recoil spring system is located toward the front of the firearm. This modification allows not only the use of the original shoulder stock, but also permits using lighter, ergonomic, or otherwise modified stocks mounted in place of the original shoulder stocks. Shoulder stocks can also be mounted on other areas of the receivers.

A further advantage of the modification is that the firearm may include, when legal, folding stocks, collapsible stocks, or no stock at all (i.e., as a pistol). The modification also allows moving or modifying the rifle stock to be placed more appropriately and comfortably against the operator's shoulder regardless of the cartridge caliber.

The modification also allows positioning the shoulder stock much lower in relation to the barrel, which allows the shooters sightline to be much lower and closer to the barrel. Because the shoulder stock is in relative close relation to the barrel, less parallax results. In addition, the lower positioning of the stock allows for a more vertical and, thus, more comfortable positioning of the shooter's head when acquiring a sightline.

The modification also reduces or eliminates the problem of propellant gas-carried heat and contamination from venting into the upper receiver of the firearm. The gas operation tube of the modified firearm does not separate from the bolt carrier, and so does not waste that portion of hot and contaminated gas into the upper receiver. A portion of the gas, however, does continue into the center cylinder of the carrier to start the movement of the bolt carrier assembly and unlock the bolt. The center cylinder of the carrier, where this portion of gas is vented, is polished hard steel that operates with little or no lubrication that could be damaged by the propellant gas-carried heat and contamination. The amount of gas that enters the bolt carrier assembly is much less than that amount of gas that enters the prior art bolt carrier assembly. These hot gases are mostly vented through holes in the carrier, directing the hot gases out through the ejection port to outside the firearm.

The modifications result in a firearm that operates both cooler and cleaner than conventional firearms, while retaining the accuracy of the conventional direct gas impingement system. In addition, because the volume of gas in an expansion chamber in the gas jet block can, in one embodiment, be varied, the firing rate of the weapon can be controlled. In one embodiment, the modification also permits the total blockage of propellant gasses so that the weapon may only be fired in a single action, single shot mode.

Figure 11:
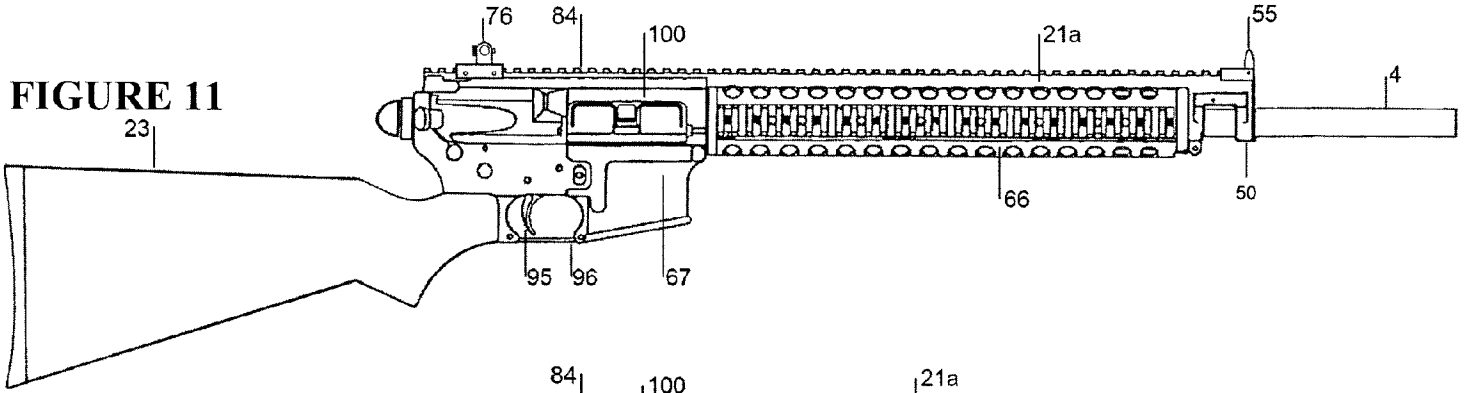
FIG. 11 is a side view of a rifle in accordance with one embodiment of the invention.
Figure 12:
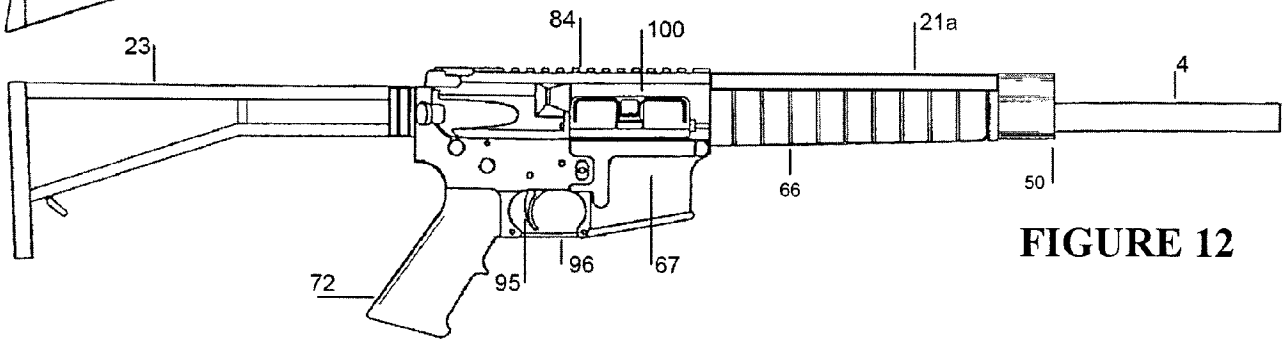
FIG. 12 is a side view of a rifle in accordance with one embodiment of the invention.
Figure 13:
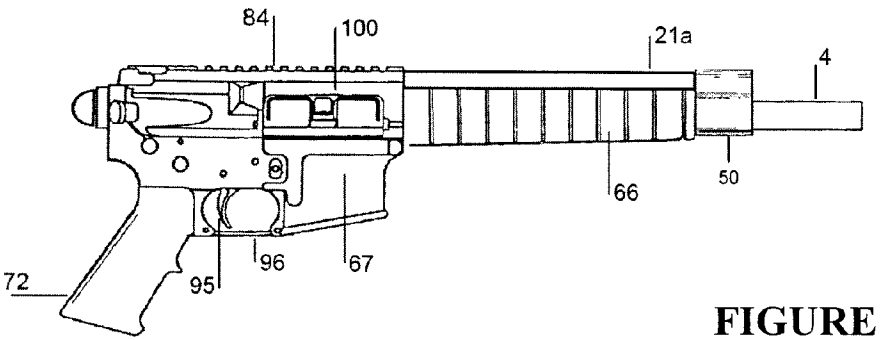
FIG. 13 is a side view of a rifle in accordance with one embodiment of the invention.

FIGS. 11-13 illustrate firearms in accordance with embodiments of the invention. It will be appreciated that the firearms shown in FIGS. 11-13 are merely exemplary and the firearms may vary from that illustrated. Each of the firearms shown in FIGS. 11-13 include an upper receiver 100 with barrel 4, handguard 66, and lower receiver 67. In each of FIGS. 11-13, the lower receiver 67 is shown with a trigger 95 and trigger guard 96.

In FIG. 11, the lower receiver 67 also includes a repositioned shoulder stock 23 and a front sight 55 is provided on the barrel 4 and a rear sight 76 is positioned on top of the receiver 100. FIG. 11 illustrates an exemplary firearm in which the shoulder stock is repositioned and the pistol grip is removed. A particular advantage of the firearm shown in FIG. 11 is that the firearm is no longer regarded as an assault weapon under federal or California law. As shown in FIG. 11, the firearm does not have a flash hider, bayonet lug, collapsible stock, or a pistol grip that, in combination with a detachable cartridge magazine, would classify a firearm as an assault weapon. Similarly configured firearms such as the Springfield M1a, the Ruger Mini-14, and the Kel-Tec SU-16 are not classified as assault weapons by the federal or California governments.

In FIG. 12, the lower receiver 67 also includes a pistol-style hand grip 72, and a folding shoulder stock 23 is connected to the upper receiver 100. FIG. 12 shows a firearm in which the recoil/buffer tube 21 at the back of the firearm has been removed and a lightweight folding stock 23 has been mounted. Reducing the weight of the firearm makes it easier to carry the firearm for extended periods of time or distances. The stock 23 may be folded up along, for example, the left side of the firearm making the firearm much shorter and easier to store and transport.

In FIG. 13, the lower receiver 67 also includes a pistol-style hand grip 72 (and no shoulder stock 23 is connected to the upper receiver 100). FIG. 13 shows a firearm that can be used as a long, high power pistol.

In one embodiment, the handguards 66 used with the firearms of FIGS. 11-13 are modified to allow access to an operation tube, recoil spring, and spring retainer (not shown) therein. The firearms of FIGS. 11-13 may include either one-piece free-floating handguards 66, as shown in FIG. 11, or handguards 66 with separate spring covers 21*a*, as shown in FIGS. 12 and 13.

Figure 14A:
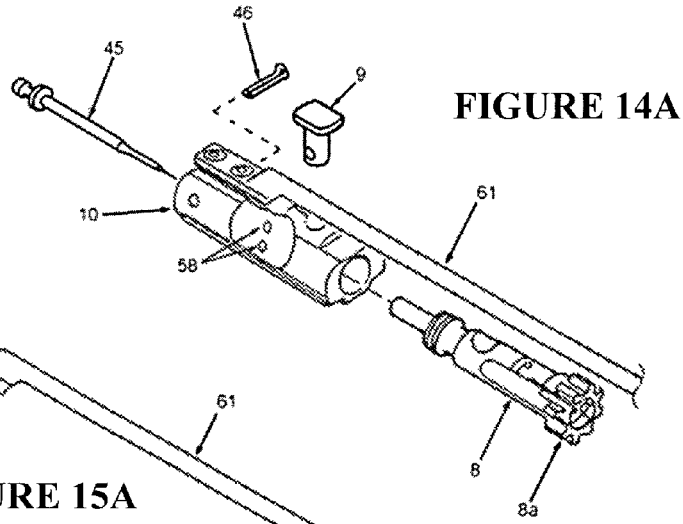
FIG. 14A is a top perspective assembly view of the bolt carrier assembly in accordance with one embodiment of the invention.

FIG. 14A illustrates the carrier assembly of the firearm. The bolt carrier assembly includes a bolt carrier 10, bolt 8, and firing pin 45. The bolt carrier assembly also includes bolt cam pin 9 and a bolt cam pin slot 9*a*. The bolt 8 includes bolt locking lugs 8*a*, and the bolt carrier 10 includes gas exhaust ports 58.

Figure 14B:
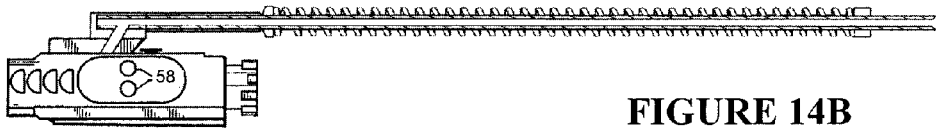
FIG. 14B is a side partial cross-sectional view of the bolt carrier assembly, operation tube and recoil spring in accordance with one embodiment of the invention.

FIG. 14B illustrates the bolt carrier assembly with the operation tube 61 affixed to the bolt carrier 10. The recoil spring 20 is wound around the operation tube 61. It will be appreciated that the spring 20, as shown in FIG. 14B, is not part of the reciprocating mass of the firearm. In addition, as shown in FIGS. 14A and 14B, the length of the bolt carrier 10 is shorter than prior art bolt carriers. In one embodiment, the bolt carrier 10 may be about three (3) inches shorter than the prior art bolt carriers, which allows for greater movement of the carrier 10 within the upper receiver 100 (without the need for the buffer/recoil tube required by the prior art firearms). Because the carrier assembly is shorter, the mass of the carrier assembly is reduced. In one example, the mass of the illustrated carrier assembly is about 9-10 ounces (e.g., 9.3 ounces), which is nearly half (e.g., 55-65% reduction) of the mass of the prior art carrier assembly. Because the carrier assembly has a lower mass the amount of energy required to cycle the firearm is reduced. This translates into less felt recoil for the operator.

Figure 15A:
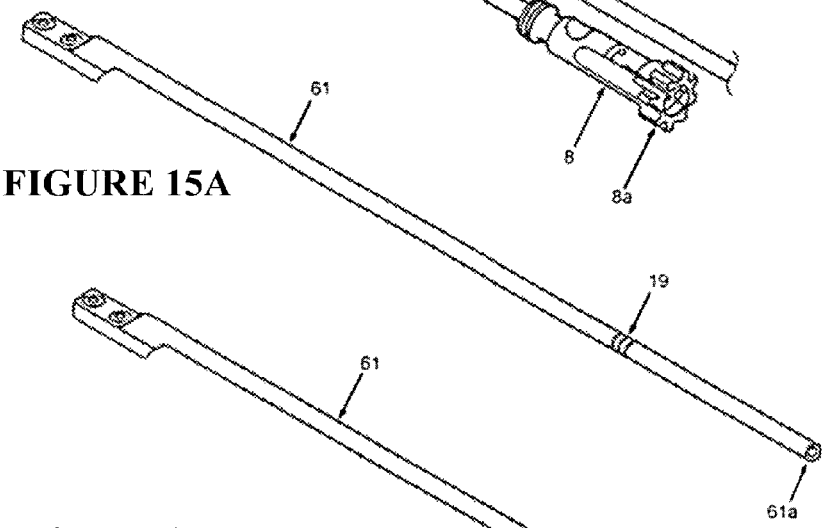
FIGS. 15A and 15B are top perspective views illustrating the operation tube in accordance with one embodiment of the invention.
Figure 15B:
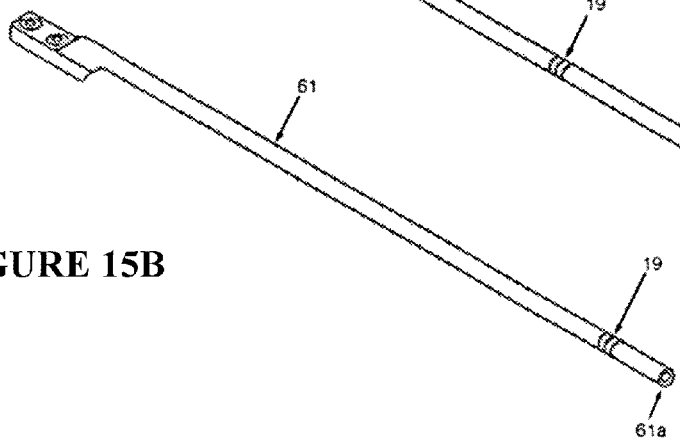

FIGS. 15A and 15B illustrates the operation tube 61 in further detail. FIG. 15A illustrates a longer operation tube and FIG. 15 illustrates a shorter operation tube. The aft (left) end of the operation tube 61 attaches to the top of the bolt carrier 10, as shown in FIG. 14. Retainer grooves 19 are provided on the fore end of the operation tube 61. In one embodiment, the retainer grooves 19 are provided about 4 inches from the fore end of the operation tube 61.

FIGS. 16-18 illustrate the operation of the carrier assembly. FIG. 16 shows the carrier assembly in battery position. As shown in FIG. 16, the burst of expanding high pressure propellant gas 59 from an ignited cartridge travels up from the barrel (not shown), and is routed aft through the gas operation tube 61, and into a void 11 within the center of the bolt carrier assembly just behind the bolt 8.

As shown in FIG. 17, the pressure of the gas 59 in the void 11 forces the bolt 8 and the bolt carrier 10 in opposite directions. The movement is similar to the movement of a piston (i.e., bolt 8) within a cylinder (i.e., bolt carrier 10). The bolt 8 is restrained from moving forward, because bolt locking lugs 8*a* are locked into the barrel extension lugs. Thus, only the bolt carrier 10 is able to move aft (towards the left in drawing). The carrier 10 moves aft, directly in line with the barrel (not shown), pulling the operation tube 61 with the carrier 10. Then, the carrier 10 engages the bolt cam pin 9 in the bolt cam slot 9*a*, rotating the bolt to unlock the bolt from the barrel extension. The bolt is in an extended, unlocked position in FIG. 17.

As shown in FIG. 18, the bolt 8 and bolt carrier 10 are then driven aft together to a full recoil position (helped by the remaining high-pressure gas in the barrel). In FIGS. 16-18, the power of the operating gas is delivered to and initiates action within the bolt carrier 10, which is directly in line with the barrel. Delivering power directly in line with the barrel minimizes vibration and barrel flex, which increases accuracy.

Figure 19:
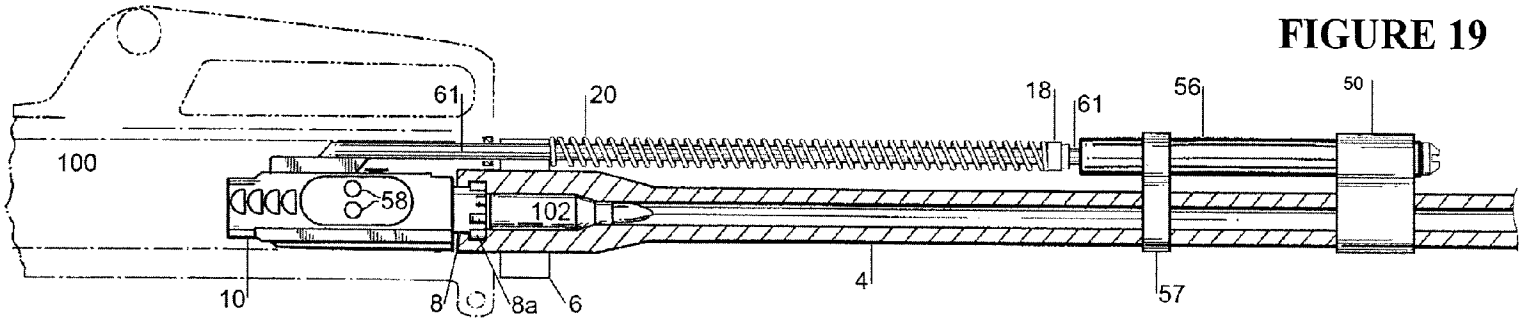
FIG. 19 is a partial cross-sectional view of the gas system in battery in accordance with one embodiment of the invention.
Figure 20:
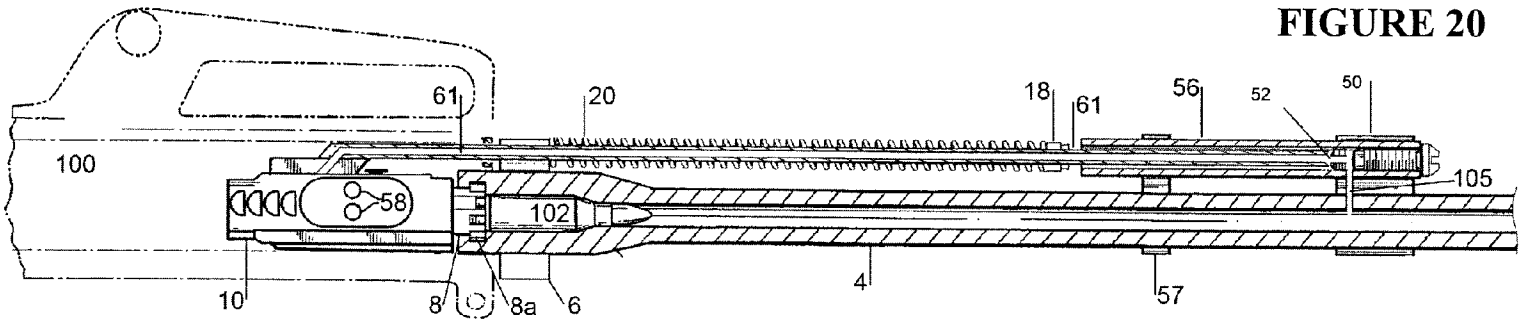
FIG. 20 is a partial cross-sectional view of the gas system of the invention in battery showing the cut-away view of the gas block, operation tube, and recoil spring.
Figure 21:
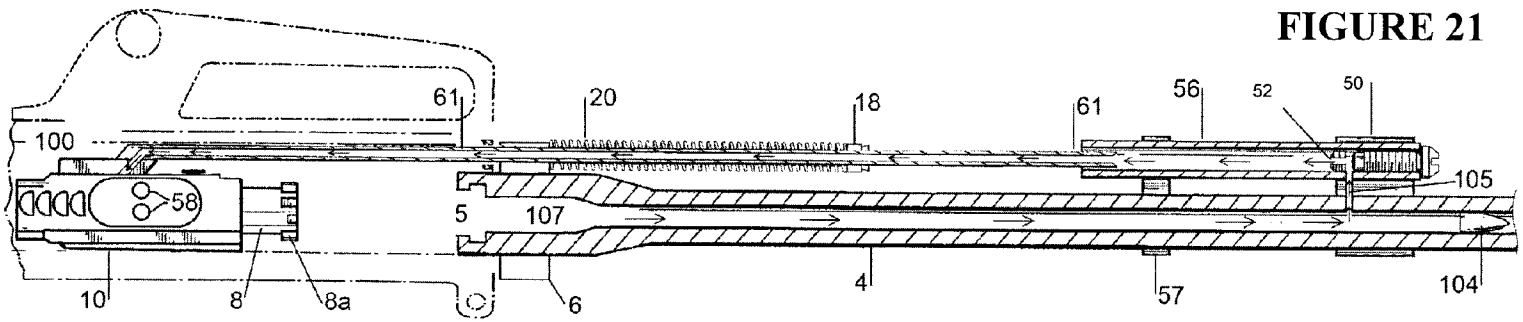
FIG. 21 is a partial cross-sectional view of the gas system in recoil in accordance with one embodiment of the invention.

FIGS. 19-21 illustrate the new gas system in further detail. FIGS. 19-20 show the new gas system in battery and FIG. 21 shows the new gas system in recoil. The gas system includes a gas jet block 50 which includes an operation tube docking port 56 mounted on top of and connected to the barrel 4. A metering gas jet 52 is provided in the operation tube docking port 56. In one embodiment, the gas jet 52 is conically-shaped. The operation tube 61 telescopes into the operation tube docking port 56 and extends rearward into the upper receiver 100. The gas jet 52 is positioned in the operation tube docking port 56 such that the gas jet 52 and the tip of the operation tube 61 are in contact or close proximity. The operation tube 61 is also attached to the top of the bolt carrier 10. A helically wound recoil spring 20 is mounted as a sleeve over a length of the gas operation tube 61. The recoil spring 20 includes a retainer 18 which engages with the retainer grooves 19 that are located near the forward end of the operation tube 61. The recoil spring 20 is also retained at the receiver 100. In one embodiment, the recoil spring 20 is retained at the receiver with a plate near the barrel nut 6. A spring cover or hand guard (not shown) may be manufactured or modified to cover and protect the operation tube 61 and recoil spring 20 mounted on top of the barrel 4, as described above.

In one embodiment, the gas jet block 50 is made of, for example, alloy steel or aluminum. In one embodiment, the operation tube docking port 56 is made of, for example, an alloy steel, and has an inner diameter of, for example, about 0.265". In one embodiment, the operation tube docking port docking port support 57 is made of, for example, alloy steel or aluminum. It will be appreciated that the gas jet block 50, operation tube docking port support 57 and the operation tube docking port 56 are sized according to the materials used, the diameter of the barrel at the gas port, and the diameter of the barrel behind the gas port. In one embodiment, the operation tube 61 telescopes approximately four (4) inches into the operation tube docking port 56 and extends rearward into the upper receiver 100 and attaches to the top of the bolt carrier 10 with two #8-32×¼ inch screws. In one embodiment, the operation tube 61 has an outer diameter of about 0.250" and an inner diameter of about 0.120" and is made of alloy steel or titanium. It will be appreciated that the length of the operation tube 61 is dictated by the length of the barrel 4 used, the location of the gas port 105 on the barrel 4, and the distance from the gas jet 52 to the operation tube attach point on the carrier 10 when in battery. In one embodiment, the gas jet 52 and operation tube 61 are positioned such that the distance between the gas jet 52 and the tip of the operation tube 61 is any value or range of values between about 0.000 and 0.005", in battery. In one embodiment, the recoil spring 20 has a length of about 8", an inner diameter of about 0.260", with a wire diameter of about 0.048" and having about 7 coils per inch. It will be appreciated that the above dimensions are merely exemplary and may be any value or range of values below or above those describe above. Similarly, it will be appreciated that the materials described above are merely exemplary and may be any other suitable material.

With reference to FIGS. 19-21, as the bullet 104 passes the barrel gas port 105, a burst of expanding high pressure propellant gas (arrows) travels up from the barrel 4, through the gas port 105 and into the gas jet block 50. From the gas jet block 50, the gas is routed aft through the metered gas jet 52, into and aft through the gas operation tube 61, and into an internal chamber (or void) 11 within the bolt carrier assembly 10. The pressure of the gas 59 in the void 11 forces the bolt 8 and the bolt carrier 10 in opposite directions, similar to the movement of a piston (i.e., bolt 8) within a cylinder (i.e., bolt carrier 10). The bolt 8 is restrained from moving forward, because bolt locking lugs 8*a* are locked into the barrel extension 5 lugs, so only the bolt carrier 10 is able to move aft. The carrier 10 moves aft, directly in line with the barrel, pulling the operation tube 61 with it. Then, the carrier 10 engages the bolt cam pin 9 in the bolt cam slot 9*a*, rotating the bolt to unlock the bolt from the barrel extension 5. At this point the gases 59 in the internal chamber 11 of the carrier assembly 10 are vented out through vent holes 58 and out of the receiver 100 through the cartridge ejection port. The bolt 8 is in an extended, unlocked position. The aft movement of the carrier 10 also moves the operation tube 61 in an aft direction, separating the gas jet 52 and operation tube 61. This separation vents excess propellant gas out of the firearm (e.g., into the void under the handguard/spring cover).

The bolt 8 and bolt carrier 10 are then driven aft together to a full recoil position, helped by the remaining high-pressure gas in the barrel. As the bolt 8 is pulled out of the barrel extension 5 the extractor pulls the spent cartridge 102 from the chamber 107 and the ejector throws the spent cartridge 107 out of the receiver 100 through the ejection port. The recoil spring 20 is compressed as the operation tube 61 is drawn into the receiver 100 by the bolt carrier assembly 10 as it is driven to its aft recoil position. This motion of the carrier assembly 10 directly in line with the barrel 4 minimizes vibration and barrel flex.

The bolt carrier assembly 10 is then pulled forward into battery position by the energy released from the compressed recoil spring 20. As the bolt carrier assembly moves towards its battery position it picks up another cartridge from the magazine, drives the cartridge into the chamber 107, and engages a cam which rotates the bolt locking lugs 8*a* into a locked position within the barrel extension 5. At the same time, the tip of the operation tube 61 comes to rest within the operation tube docking port 56, in contact with, or in close proximity to, the gas jet 52. The firearm is then ready to fire the next round.

It will be appreciated that the gas jet 52 may be varied to regulate the gas pressure in the operation tube 61 by changing the diameter of the orifice and/or shape of the gas jet 106. For example, the gas jet 52 may increase or decrease the flow of gas by unscrewing and replacing the metered gas jet 52 with one having a different sized port opening. In addition, in one embodiment, the position of the gas jet 52 in the gas block 50 may be varied by, for example, screwing or unscrewing the gas jet 52.

The flow of gas may also be reduced or cut off completely by actuating the operation tube docking port end screw 53. When the port 105 is blocked by the gas port end screw 53, the gas flow in the gas system is constricted or stopped. Total blockage of the propellant gasses allows the firearm to be fired in a single shot, non-automatic mode. The operation tube docking port end screw 53 may also be removed to clean the docking port 56 or to confirm docking port alignment.

Figure 22:
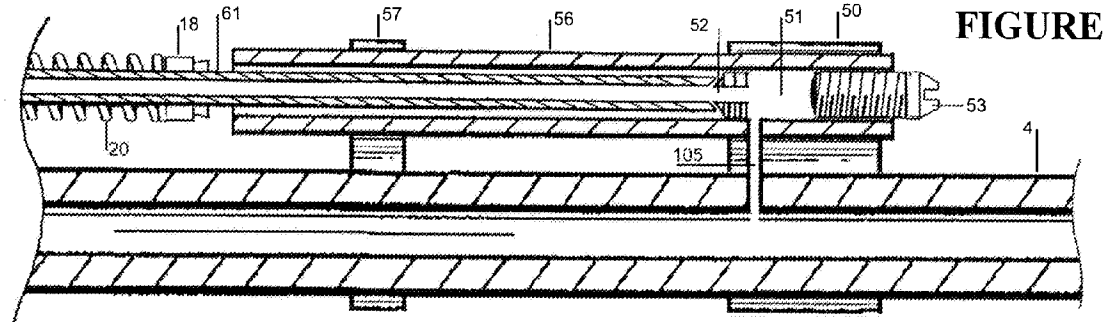
FIG. 22 is a cross-sectional view of the gas block in accordance with one embodiment of the invention.

In one embodiment, the operation tube docking port end screw 53 is actuated to create and/or alter the size of an expansion chamber 51 in the gas jet block 50 between the gas jet 52 and the operation tube docking port end screw 53, as shown in FIG. 22. The size of the expansion chamber is determined by the amount of actuation of the end screw 53. In embodiments having an expansion chamber, the gas in the barrel 4 passes through the port 105 into the expansion chamber 51, momentarily slowing the gas until the expansion chamber is sufficiently pressurized. The gas is then routed through the gas jet 52 as described above.

Delivery of the gas into the expansion chamber modifies the gas timing of the firearm. In particular, the operating gas slows as it takes time to raise the gas pressure in the chamber before passing through the gas jet 52. For example, when the volume of the expansion chamber is reduced, the delay of the gas that initiates the movement of the bolt carrier 10 is reduced; and, when the volume of the expansion chamber is increased, the delay of the gas to initiate the movement of the bolt carrier 10 is increased. This delay gives the spent cartridge time to contract enough to loosen its grip on the chamber walls, which makes it easier for the extractor to pull the case out of the chamber and reduces the occurrence of cycling problems.

Figure 24:
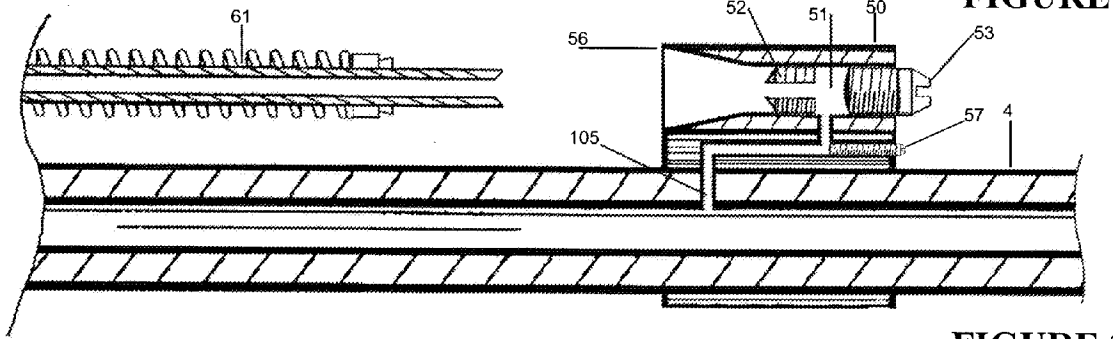
FIG. 24 is a cross-sectional view of the gas block in accordance with one embodiment of the invention.
Figure 23:
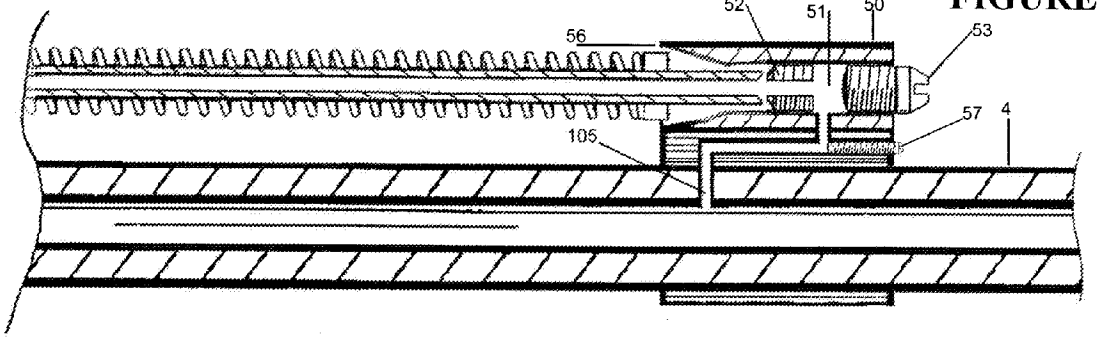
FIG. 23 is a cross-sectional view of the gas block in accordance with one embodiment of the invention.

It will be appreciated that the configuration of the gas block may vary from that illustrated. An alternative configuration of the gas jet block is illustrated in FIGS. 23 and 24. FIG. 23 shows the gas jet block 50 when the firearm is in battery, and FIG. 24 shows the gas jet block 50 when the firearm is in recoil As shown in FIGS. 23 and 24, the internal diameter of the gas block 50 varies. In particular, the diameter at the operation tube docking port 56 is larger than the diameter at the expansion chamber 51 and gas jet 52. Furthermore, the gas jet block 50 shown in FIGS. 23 and 24 is shorter than the gas jet block 50 described above with reference to FIGS. 19-21.

Figure 25:
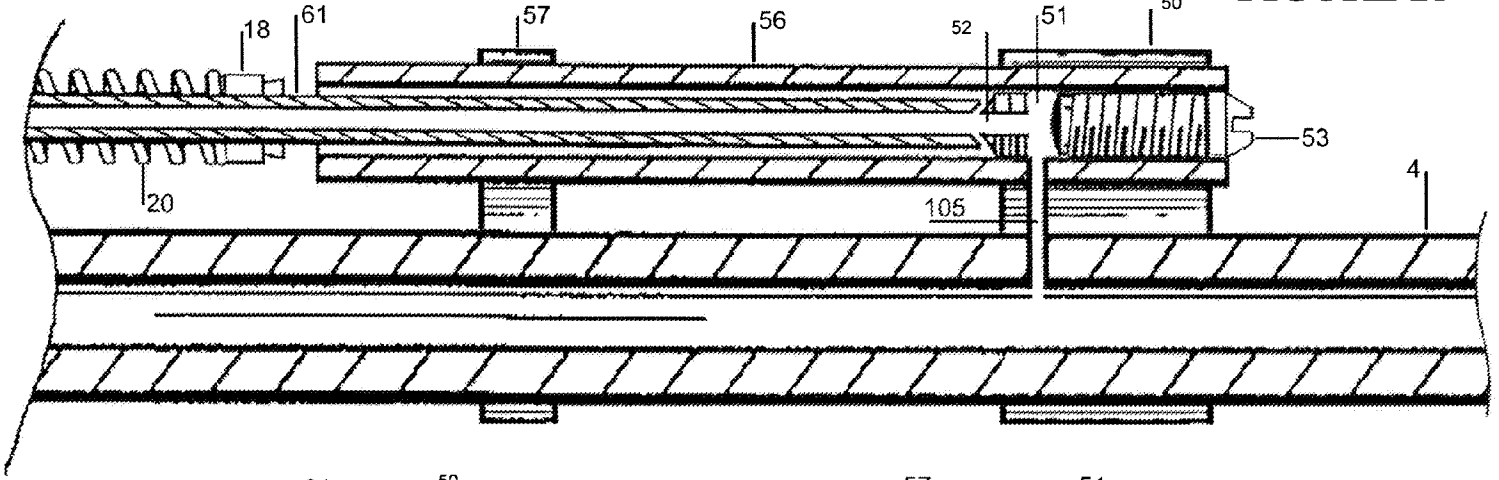
FIG. 25 is a cross-sectional view of the gas block for 18-inch and longer barrels in accordance with one embodiment of the invention.
Figure 26:
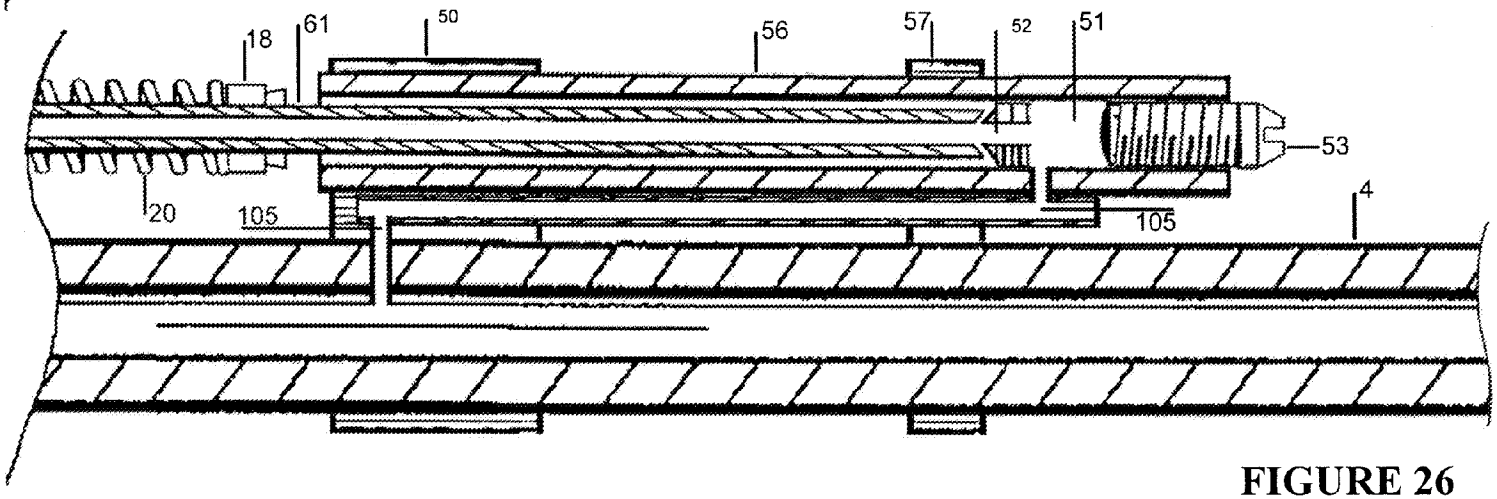
FIG. 26 is a cross-sectional view of the gas block for 18-inch and shorter barrels in accordance with one embodiment of the invention.

FIGS. 25 and 26 illustrate the gas jet block areas in further detail. FIG. 25 illustrates an exemplary gas jet block area for rifles having barrel lengths 18" and over. In FIG. 25, the gas port 105 extends vertically from the barrel 4 to directly connect the barrel 4 with the gas block 50. As the bullet 104 passes the barrel gas port 105 a burst of expanding high pressure propellant gas (arrows) travels up from the barrel 4, through the gas port 105, into the gas jet block 50, then is routed aft through the gas jet 52, into and aft through the gas operation tube 61.

FIG. 26 illustrates an exemplary gas jet block area for rifles having barrel lengths 18" and under. In FIG. 26, the gas port 105, however, extends up from the barrel 4, extends horizontally along a length of the barrel 4 and then extends up to the gas jet block 50. In the gas block assembly of FIG. 26, gas from the barrel 4 is routed up the gas port 105 and is directed through the small tube that is mounted below the operation tube docking port 56, and then up into the operation tube docking port 56, and aft through gas jet 52 and operation tube 61.

In FIG. 25, the gas port 105 is positioned farther away from the receiver 100 than the gas port 105 of FIG. 26. The distance of the gas jet block 50 from the receiver remains almost the same. The change in design is dictated by the distance of the gas port 105 from the upper receiver. The position of the gas jet block 50 in FIG. 26 maintains at least approximately 7-8" of free spring length for recoil operation. It will be appreciated that added recoil length may vary.

Figure 27:
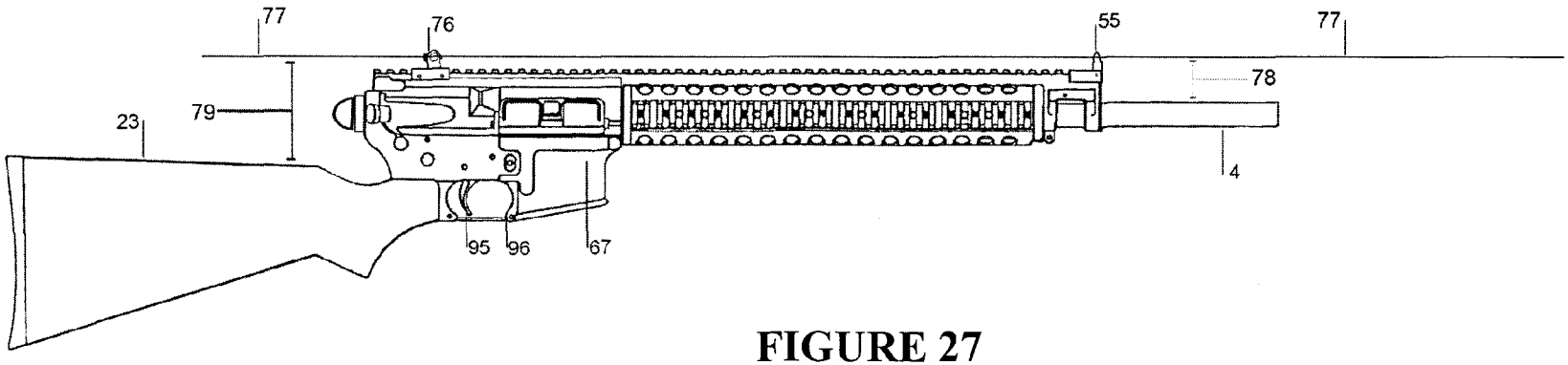
FIG. 27 is a side view of a firearm in accordance with one embodiment of the invention.

FIG. 27 shows a modified firearm modified showing the pistol grip removed and the shoulder stock 23 repositioned onto a modified pistol grip mount. As described above, this rifle no longer needs a recoil/buffer assembly 17 at the back of the firearm; thus, the recoil/buffer assembly 17 is removed and the receiver is capped. The recoil spring has been moved to the front of the rifle, over the barrel 4, where it is protected by the spring cover 21*a*.

Figure 10:
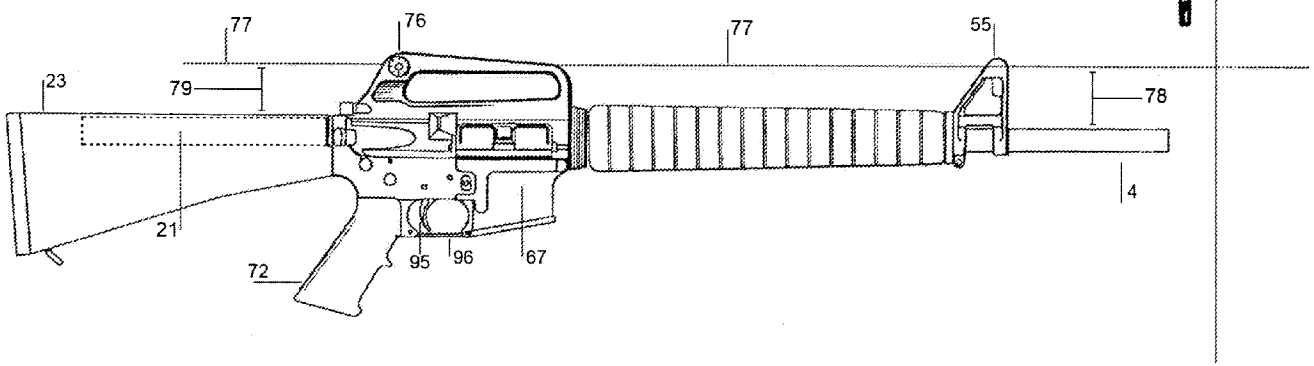
FIGURE 10 PRIOR ART
FIG. 10 is a side view of a prior art gas impingement operated M-16/AR-15 style firearm.

The firearm shown in FIG. 27 includes a standard rifle style shoulder stock 23 without a pistol grip 72. Because the illustrated firearm does not include the recoil/buffer assembly 17, the sightline 77 is closer to the line of the barrel 4. Line 79 indicates the distance between the sightline 77 and the shoulder stock 23. The distance 79 of the modified firearm shown in FIG. 27 is greater than the distance 79 of the prior art firearms shown in FIG. 10. Line 78 indicates the distance between the sightline 77 and the barrel 4. The distance 78 of the modified firearm shown in FIG. 27 is shorter than the distance 78 of the prior art firearms shown in FIG. 10. Because the sightline is closer to the barrel, parallax is reduced. Because the distance between the sightline and the shoulder stock is sufficient, the operator's head position is more comfortable.

Figure 28:
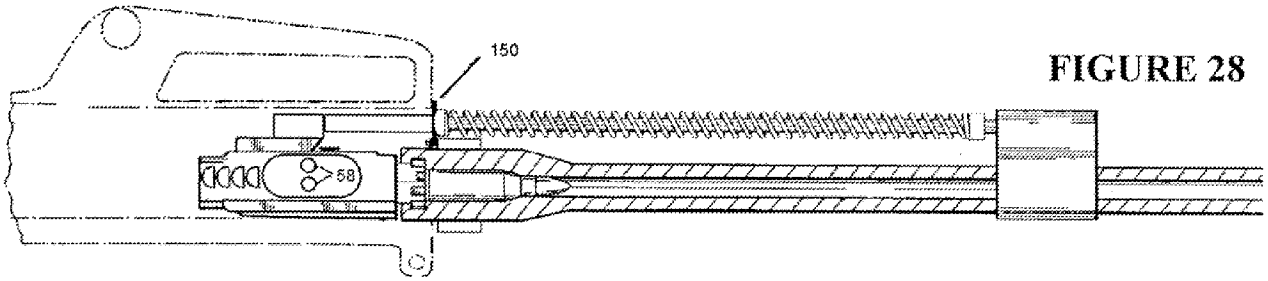
FIG. 28 is a cross-sectional view of a rifle in accordance with one embodiment of the invention.
Figure 29:
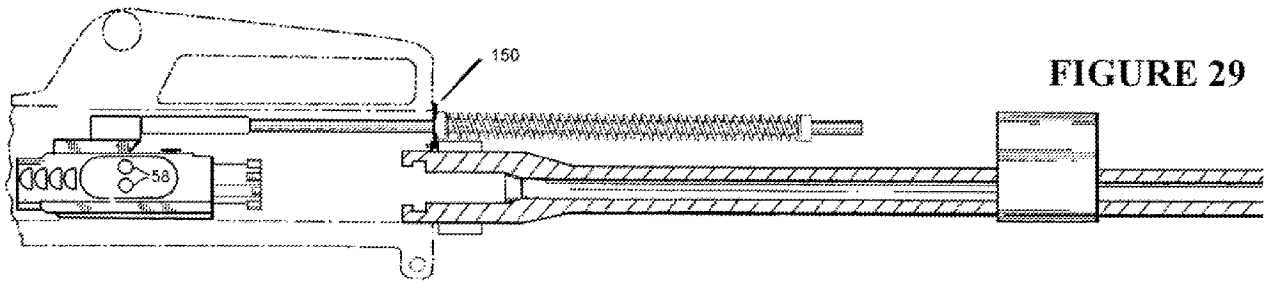
FIG. 29 is a cross-sectional view of a rifle in accordance with one embodiment of the invention.
Figure 30:
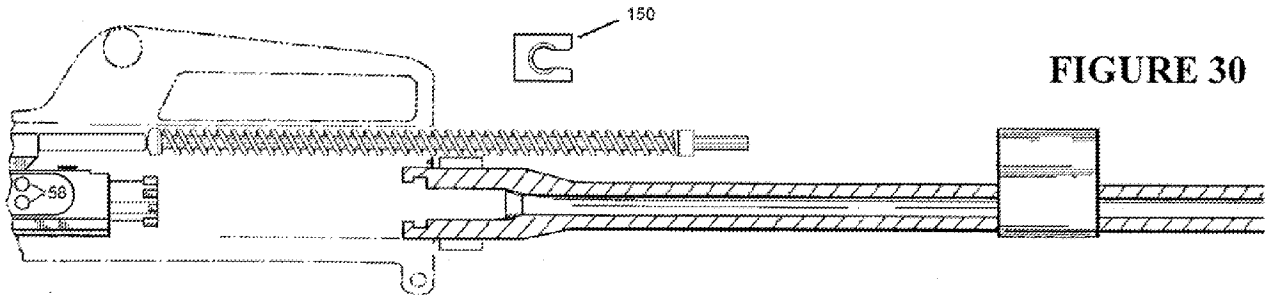
FIG. 30 is a cross-sectional view of a rifle in accordance with one embodiment of the invention.

FIGS. 28-30 illustrate the modified firearm with a retaining clip 150 between the recoil spring 61 and the upper receiver 100. The retaining clip 150 is configured to be removed from the retaining configuration by, for example, pulling the retaining clip 150 sideways. The retaining clip 150 may include a detent that is configured to be secured around the operation tube. The retaining clip 150 is held in the retaining configuration by the detent and the spring pressure from the recoil spring.

When the retaining clip 150 is removed from the retaining configuration, the bolt carrier assembly, operation tube 61, and recoil spring 20 can be removed for inspection, cleaning, or repair. In particular, when the retaining clip 150 is removed, the bolt carrier assembly, operation tube 61, and recoil spring 20 can slide out of the receiver 100. If needed, the operation tube 61 and recoil spring 20 may then be removed from the bolt carrier assembly by removing screws that attach the operation tube 61 to the carrier 10 and sliding the operation tube 61 and recoil spring 20 off of the bolt carrier assembly.

In an alternative embodiment, the spring retainer 18 may be used to remove the bolt carrier assembly, operation tube 61, and recoil spring 20 for inspection, cleaning, or repair. In one embodiment, the recoil spring 20 is retracted towards the receiver 100 for a short distance. For example, the recoil spring 20 may be retracted approximately one half inch. Then, the spring retainer 18 is removed from the operation tube 61 and the spring 20 is slowly decompressed. The bolt carrier assembly and operation tube 61 may then be moved towards the back of the receiver 100, far enough to clear the tip of the operation tube 61 from the operation tube docking port 56. Next, the recoil spring 20 is removed by sliding it forward off of the operation tube 61.

In short, the modifications described herein have a significant and positive effect in the operation, handling and efficient use of the weapon. For example, the firearms are a more compact size and reduced weight, yet retain the accuracy, the firepower, and many of the components of its predecessor. In another example, the firearm is cooler and cleaner because the hot and fouling operating gases are prevented from being vented into the upper receiver. In a further example, the recoil spring is relocated from behind the receiver to the front of the firearm, permitting the use of unconventional shoulder stock types and placement, folding stocks, or operation of the firearm as a pistol.

In addition, because excess high pressure gas in the system is vented around the sides of the operation tube when the carrier is moved, the new gas operating system does not cause the modified firearm to be as over-pressurized as the prior art firearms because the new gas operating system self-regulates the gas pressure that reaches the bolt carrier.

Furthermore, rifles, short barreled rifles and pistols of the M-16/AR-15 family modified as described herein operate more dependably and function more reliably while being able to use a greater range of ammunition. These modified firearms also have less stress applied to their components by the high pressure gases. In addition, the extractor parts last longer and are less likely to break because the extractor is not as prone to slip off the case rim, damage the case or rip it apart. The system can also be set to operate with a less powerful cartridge, the excess gas pressure from more powerful cartridges being vented out of the system.

It should be understood that the foregoing description is only illustrative of the invention. Various alternatives and modifications can be devised by those skilled in the art without departing from the invention. In addition, many suitable sizes and shapes or type of elements or materials could be used. Accordingly, the present invention is intended to embrace all such alternatives, modifications and variances which fall within the scope of the invention as described.

What is claimed is:

1. A method comprising: directing gas from a barrel of a firearm upward through a barrel gas port; routing the gas from the barrel gas port to a gas jet block comprising a gas operation tube docking port and a gas jet; directing the gas through the gas jet and into a gas operation tube docked in the gas operation tube docking port and engaged with the gas jet; directing the gas through the gas operation tube to a bolt carrier assembly, to which the gas operation tube is fixed, to move at least a portion of the bolt carrier assembly relative to the barrel, the movement of the at least a portion of the bolt carrier assembly causing the gas operation tube to axially translate within the docking port such that it disengages from the gas jet as a function of gas pressure in the bolt carrier assembly; and venting gas from the gas jet block through the gas jet when the gas operation tube disengages from the gas jet.

2. The method of claim 1, wherein the bolt carrier assembly comprises a bolt carrier and a bolt, and wherein directing the gas to the bolt carrier assembly to move at least a portion of the bolt carrier assembly relative to the barrel comprises:

directing the gas into a void in the bolt carrier to force the bolt and the bolt carrier to move in opposite directions as a function of the gas pressure in the void;

moving the bolt carrier and operation tube in an aft direction when the gas pressure in the void is sufficient to move the bolt carrier and operation tube in the aft direction, the movement of the gas operation tube compressing a recoil spring coupled with the operation tube;

engaging the carrier with a cam to unlock the bolt from a barrel extension; and moving the bolt carrier and bolt in an aft direction.

3. The method of claim 2, further comprising releasing the recoil spring to pull the bolt carrier assembly forward.

* * * * *